US007390995B2

(12) United States Patent
Hasegawa et al.

(10) Patent No.: US 7,390,995 B2
(45) Date of Patent: Jun. 24, 2008

(54) IMAGE FORMING APPARATUS, FIXING DEVICE AND IMAGE HEATER HAVING AN ADJUSTABLE EXCITING MEMBER

(75) Inventors: Motokazu Hasegawa, Kanagawa-ken (JP); Norihiko Aze, Kanagawa-ken (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 11/444,412

(22) Filed: Jun. 1, 2006

(65) Prior Publication Data

US 2006/0289420 A1 Dec. 28, 2006

(30) Foreign Application Priority Data

Jun. 1, 2005 (JP) ..... 2005-161908

(51) Int. Cl.
*H05B 6/14* (2006.01)
*G03G 15/20* (2006.01)

(52) U.S. Cl. ..... 219/619; 219/652; 219/667; 219/673; 219/672; 399/328; 399/330

(58) Field of Classification Search ..... 219/619, 219/670, 652, 667, 672–676; 399/328–335
See application file for complete search history.

(56) References Cited

U.S. PATENT DOCUMENTS 4,258,241 A * 3/1981 Soworowski ..... 219/656
5,745,833 A * 4/1998 Abe et al. ..... 399/330
7,183,526 B2 * 2/2007 Yoshino et al. ..... 219/635
2005/0286938 A1 * 12/2005 Aze et al. ..... 399/328
2006/0056890 A1 3/2006 Aze et al.
2006/0289420 A1 12/2006 Hasegawa et al.

FOREIGN PATENT DOCUMENTS

| | | |
|---|---|---|
| JP | 04-264479 | 9/1992 |
| JP | 08-152798 | 6/1996 |
| JP | 2000-075702 | 3/2000 |
| JP | 2000-162912 | 6/2000 |
| JP | 2000-214703 | 8/2000 |
| JP | 2001-176648 | 6/2001 |
| JP | 2002-245535 | 8/2002 |
| JP | 2005-070376 | 3/2005 |

OTHER PUBLICATIONS

U.S. Appl. No. 11/613,039, filed Dec. 19, 2006, Aze et al.
U.S. Appl. No. 11/167,845, filed Jun. 28, 2005, Aze et al.
U.S. Appl. No. 11/221,687, filed Sep. 9, 2005, Aze et al.

* cited by examiner

*Primary Examiner*—Philip H. Leung
(74) *Attorney, Agent, or Firm*—Oblon, Spivak, McClelland, Maier & Neustadt, P.C.

(57) ABSTRACT

An image forming apparatus includes a fixing device which fixes a toner image on a recording medium. The fixing device includes a heating device. The heating device includes a heat-generating member, an exciting member, and a changing device. The heat-generating member is subjected to electromagnetic induction heating. The exciting member is placed to sandwich a front surface and a rear surface of the heat-generating member, without contacting the heat-generating member. The changing device changes an opposing distance of the exciting member to at least one of the front surface and the rear surface of the heat-generating member.

23 Claims, 9 Drawing Sheets

IMAGE FORMING APPARATUS, FIXING DEVICE AND IMAGE HEATER HAVING AN ADJUSTABLE EXCITING MEMBER

CROSS REFERENCE TO RELATED APPLLICATION

This application claims priority to Japanese patent application no. 2005-161908 filed on Jun. 1, 2005, the entire contents of which are hereby incorporated by reference herein.

BACKGROUND OF THE INVENTION

1. Field of the Invention

The present invention relates to a heating device using an electromagnetic induction heating method, a fixing device of an image forming apparatus including the heating device, and an image forming apparatus including the fixing device, such as a copier, a printer, a facsimile machine, and a complex machine thereof.

2. Discussion of the Background Arts

In a widely-known background image forming apparatus, such as a copier and a printer, a fixing device using an electromagnetic induction heating method is used to reduce the start-up time of the fixing device in order to reduce energy consumption.

A first example of the background fixing device using an electromagnetic induction heating method includes a support roller (i.e., a heating roller), a fixing support roller (i.e., a fixing roller), a fixing belt extended under tension by the support roller and the fixing support roller, an induction heating device facing the support roller via the fixing belt, a pressure roller in contact with the fixing support roller via the fixing belt, and so forth. The induction heating device includes an exciting coil extending in the width direction (i.e., a direction perpendicular to a direction of conveying a recording medium), an exciting coil core facing the exciting coil, and so forth.

The fixing belt is heated at a position facing the induction heating device. The heated fixing belt heats a toner image formed on the recording medium, when the recording medium is conveyed to a position between the fixing support roller and the pressure roller. Thereby, the toner image is fixed on the recording medium. Specifically, the exciting coil is applied with a high-frequency alternating current, and an alternating magnetic field is generated around the exciting coil. Thereby, an overcurrent is generated near a surface of the support roller, and Joule heat is generated due to the electric resistance of the support roller. The thus generated Joule heat is used to heat the fixing belt wound around the support roller.

In the first example of the background fixing device using an electromagnetic induction heating method, the surface temperature of the fixing belt (i.e., a fixing temperature) can be increased to a desired value in a relatively short start-up time with lower energy consumption than in a fixing device using another method, such as a heat roller method.

In a second example of the background fixing device using an electromagnetic induction heating method, a magnetic conductor having a Curie point is used to form a heat-generating member (i.e., a heat-generating device) so that the heat-generating member has a self-temperature controlling function.

Further, in the second example of the background fixing device, to prevent the heat-up time at start-up of the fixing device (i.e., the start-up time) from being prolonged, two magnetic metal members of different Curie points are laminated with each other to form a heat-generating member, and the frequency of the alternating current supplied to an exciting member (i.e., an exciting device) is changed.

In a third example of the background fixing device using an electromagnetic induction heating method, the core of an induction heating device sandwiches a fixing belt. That is, the core of the induction heating device faces both the outer circumferential surface and the inner circumferential surface of the fixing belt for improving the heat-generating efficiency of the fixing belt.

In the second example of the background fixing device, the heat-generating member has the self-temperature controlling function. Therefore, the temperature of a fixing member can be prevented from being excessively increased, with no need for a complicated temperature controlling operation performed by an electric circuit, compared with the first example of the background fixing device. However, the second example of the background fixing device is still open to improvements.

For example, at a temperature near the Curie point of the heat-generating member, the relative magnetic permeability of the heat-generating member (i.e., a conductive layer thereof) is decreased, and the gradient of the increase in temperature of the heat-generating member is reduced. Due to the reduction of the gradient of the temperature increase, therefore, it is highly possible that the heat-up time at start-up of the fixing device is prolonged. That is, in the second example of the background fixing device, while the excessive increase in temperature of the fixing member can be prevented by the self-temperature control of the heat-generating member, the start-up performance of the fixing device is insufficient.

In view of the above, if the two magnetic metal members of different Curie points are laminated to each other to form a heat-generating member, and if the frequency of the alternating current supplied to the exciting member is changed, an effect of preventing the excessive increase in temperature of the fixing member through the self-temperature control of the heat-generating member, and an effect of reducing the start-up time of the fixing device can be expected. That is, through the adjustment of the frequency of the alternating current, the magnetic metal member having a Curie point higher than the fixing temperature is caused to generate heat at the start-up of the fixing device for preventing the reduction of the gradient of the temperature increase. Then, after the fixing device has been started up, the other magnetic metal member having a Curie point near the fixing temperature is caused to generate heat for preventing the excessive increase in temperature of the heat-generating member.

In the above example of the background fixing device, the benefits of both a reduction of the start-up time and a prevention of an excessive increase in temperature can be obtained. The background fixing device, however, tends to be complicated in structure due to the multilayer structure of the heat-generating member and to be relatively high in cost. Further, since the heat-generating member has the multilayer structure including the two magnetic metal members of different linear expansion coefficients, it is highly possible that heat strain occurs in the heat-generating member due to the difference in the linear expansion coefficients. If heat strain occurs in the heat-generating member, the layers of the heat-generating member may be separated and damaged, and thus the performance of the heat-generating member (e.g., conveying performance of a fixing belt formed by the heat-generating member) may be deteriorated.

On the other hand, in the third example of the background fixing device, the shape of the core of the induction heating device is improved such that the core sandwiches the fixing belt to improve the heat-generating efficiency of the fixing belt. However, prevention of an excessive increase in temperature of the fixing member cannot be obtained.

The above-described limitations are also found in other conventional devices.

SUMMARY OF THE INVENTION

The present invention includes an image forming apparatus including a fixing device which fixes a toner image on a recording medium. The fixing device includes a heating device. The heating device includes a heat-generating member, an exciting member, and a changing device. The heat-generating member is subjected to electromagnetic induction heating. The exciting member is placed to sandwich a front surface and a rear surface of the heat-generating member, without contacting the heat-generating member. The changing device changes an opposing distance of the exciting member to at least one of the front surface and the rear surface of the heat-generating member.

The present invention also includes a fixing device which fixes a toner image on a recording medium. In one example, a fixing device which fixes a toner image on a recording medium includes a heating device. The heating device includes a heat-generating member, an exciting member, and a changing device. The heat-generating member is subjected to electromagnetic induction heating. The exciting member is placed to sandwich a front surface and a rear surface of the heat-generating member, without contacting the heat-generating member. The changing device changes an opposing distance of the exciting member to at least one of the front surface and the rear surface of the heat-generating member.

The present invention also includes a heating device having a heat-generating member, an exciting member, and a changing device. The heat-generating member is subjected to electromagnetic induction heating. The exciting member is placed to sandwich a front surface and a rear surface of the heat-generating member, without contacting the heat-generating member. The changing device changes an opposing distance of the exciting member to at least one of the front surface and the rear surface of the heat-generating member.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
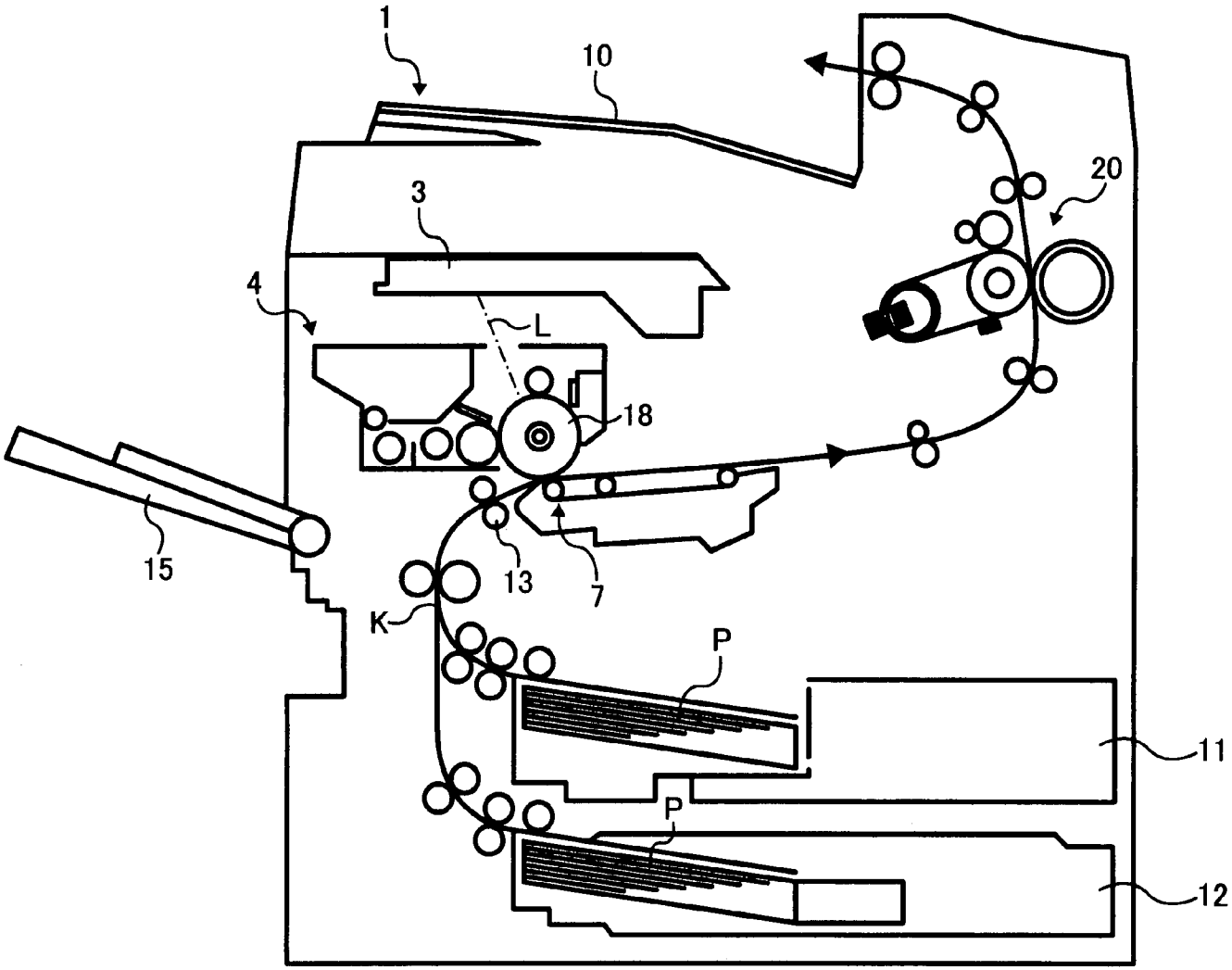
FIG. 1 is an overall view of a configuration of an image forming apparatus according to a first embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIGS. 1 to 6, an image forming apparatus 1 according to a first embodiment of the present invention will be described. Description of previously described components will be appropriately omitted or simplified.

With reference to FIG. 1, the configuration and operations of the entirety of the image forming apparatus 1 will now be described.

In FIG. 1, the image forming apparatus 1 is a laser printer in this example. The image forming apparatus 1 includes an exposure unit 3, a process cartridge 4, a transfer unit 7, a sheet discharge tray 10, sheet feeding units 11 and 12, registration rollers 13, a manual sheet feeding unit 15, a photoconductor drum 18, and a fixing device 20.

The exposure unit 3 applies an exposure light EL onto the photoconductor drum 18 in accordance with image data. The process cartridge 4 serves as an image forming unit which can be attached to and detached from the image forming apparatus 1. The transfer unit 7 transfers a toner image formed on the photoconductor drum 18 to a recording medium P. The recording medium P carrying thereon the toner image is output from the image forming apparatus 1 to be discharged onto the sheet discharge tray 10. The recording medium P, such as a transfer sheet, is stored in one of the sheet feeding units 11 and 12 and the manual sheet feeding unit 15. The registration rollers 13 convey the recording medium P to the transfer unit 7. The photoconductor drum 18 serves as an image carrying member. The fixing device 20 fixes an unfixed image onto the recording medium P.

With reference to FIG. 1, operations of the image forming apparatus 1 in a normal image forming process will now be described.

The exposure unit 3 first emits the exposure light EL, such as a laser beam, in accordance with the image data onto the photoconductor drum 18 of the process cartridge 4, which rotates in the counterclockwise direction in the drawing. Through predetermined electrophotographic processes (i.e., a charging process, an exposure process, and a development process), a toner image in accordance with the image data is formed on the photoconductor drum 18. Thereafter, the toner image formed on the photoconductor drum 18 is transferred onto the recording medium P which has been conveyed by the registration rollers 13.

Although not illustrated in the drawing, in addition to the photoconductor drum 18, the process cartridge 4 integrally includes a charging unit which charges a surface of the photoconductor drum 18, a development unit which stores a toner (i.e., a developer) and develops an electrostatic latent image formed on the photoconductor drum 18, a cleaning unit which removes the toner not transferred and remaining on the surface of the photoconductor drum 18, and so forth.

A method of conveying the recording medium P to the transfer unit 7 is performed as follows.

One of a plurality of the sheet feeding units of the image forming apparatus 1 (i.e., the sheet feeding units 11 and 12 and the manual sheet feeding unit 15) is first selected automatically or manually. By way of example only, it will be henceforth be assumed that the sheet feeding unit 11 is selected. Then, the uppermost one of the recording mediums P stored in the sheet feeding unit 11 is conveyed to a conveyance path K. The recording medium P is then conveyed through the conveyance path K and reaches the registration rollers 13. The recording medium P thus reached the registration rollers 13 is sent to the transfer unit 7 in appropriate timing such that the recording medium P is aligned with the toner image formed on the photoconductor drum 18.

After the transfer process, the recording medium P which has passed the transfer unit 7 is further conveyed through the conveyance path to reach the fixing unit 20. The recording medium P thus reached the fixing unit 20 is sent into a nip between a fixing belt 22 and a pressure roller 30, and the toner image is fixed on the recording medium P by the heat applied by the fixing belt 22 and the pressure applied by the pressure roller 30. The recording medium P on which the toner image has been fixed is then sent out from the nip between the fixing belt 22 and the pressure roller 30. Then, the recording medium P carrying thereon the output image is discharged from the image forming apparatus 1 onto the sheet discharge tray 10. Thereby, a sequence of the image forming process is completed.

A configuration and operations of the fixing device 20 of the image forming apparatus 1 will now be described.

Figure 2:
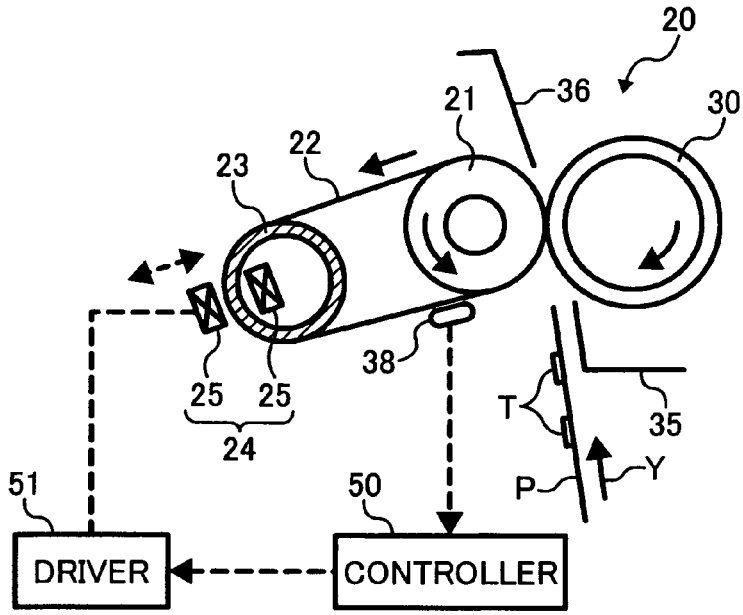
FIG. 2 is a cross-sectional view of the fixing device of the image forming apparatus illustrated in FIG. 1.

As illustrated in FIG. 2, the fixing device 20 mainly includes a fixing support roller 21, the fixing belt 22, a support roller 23, an induction heating device 24, the pressure roller 30, a thermistor 38, a guide plate 35, and a separation plate 36. The fixing device 20 of the image forming apparatus 1 according to the first embodiment includes a heating device using an electromagnetic induction heating method. The heating device is formed by the support roller 23 and the induction heating device 24 which includes a coil 25.

The fixing support roller 21 includes a cored bar formed of stainless steel, carbon steel, or the like. A surface of the cored bar is covered by an elastic layer formed of a silicone rubber or the like. The elastic layer of the fixing support roller 21 is set to have a radial thickness of from approximately 3 millimeters to approximately 10 millimeters and an Asker hardness of from approximately 10 degrees to approximately 50 degrees. The fixing support roller 21 is driven to rotate by a driving device (not illustrated) in the counterclockwise direction in FIG. 2.

Figure 4:
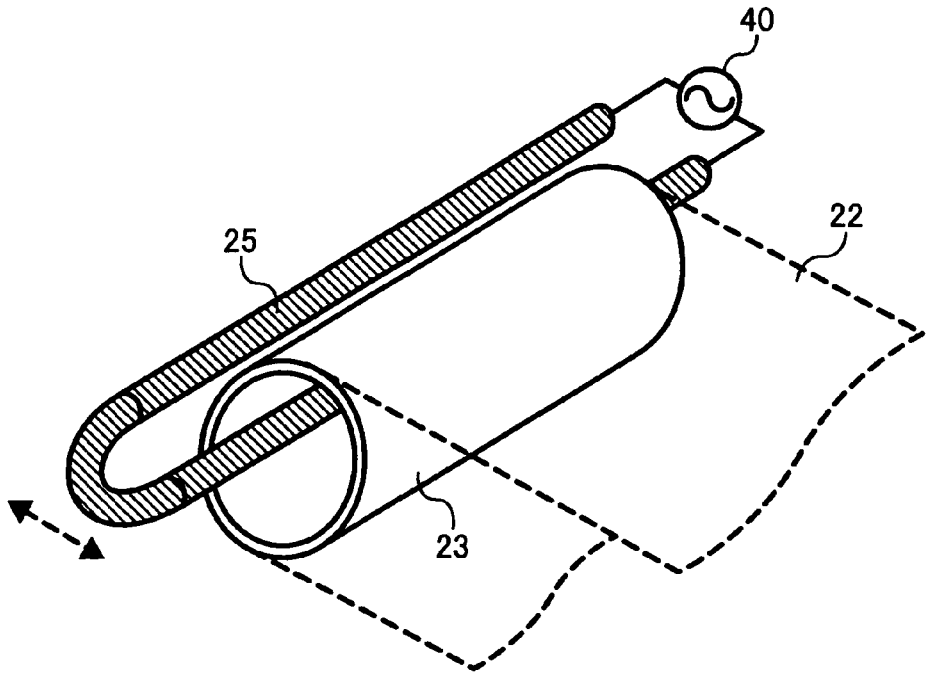
FIG. 4 is a perspective view of the heating device of the fixing device illustrated in FIG. 2.

The support roller 23, which serves as a heating member (i.e., a heat-generating member), includes a conductive layer, which forms a cylindrical portion of the support roller 23 and is formed by a magnetic conductive material. The cylindrical portion of the support roller 23 is set to have a radial thickness (i.e., a layer thickness) of approximately 0.6 millimeters. The support roller 23 rotates in the counterclockwise direction in FIG. 2. The coil 25 is placed to face the front surface and the rear surface (i.e., the outer circumferential surface and the inner circumferential surface) of the support roller 23, as illustrated in FIG. 4.

The material forming the support roller 23, which serves as the heat-generating member, may be a magnetic conductive material, such as nickel, iron, chrome, and an alloy thereof. In the first embodiment, the support roller 23 is formed solely by the conductive layer and thus has a single-layer structure. Specifically, the material (i.e., the conductive layer) forming the support roller 23 is a magnetic shunt alloy having a Curie point equal to or higher than an approximate target controlled temperature of the fixing belt 22 (i.e., a target fixing temperature, which is approximately 150 degrees Celsius) and equal to or lower than approximately 500 degrees Celsius (preferably, equal to or lower than approximately 300 degrees Celsius). More specifically, the magnetic shunt alloy is an alloy of nickel, iron, and chrome. The Curie point of the magnetic shunt alloy can be set to a desired value by adjusting processing conditions and the amounts of the respective materials forming the magnetic shunt alloy. With the support roller 23 thus formed by the conductive layer which has the Curie point near the target fixing temperature of the fixing belt 22, the support roller 23 is heated by electromagnetic induction without being overheated. The mechanism of the heating process will be later described in detail. In the first embodiment, the support roller 23 is formed solely by the conductive layer, as described above. Alternatively, the conductive layer of the support roller 23 may be covered by a reinforcement layer, an elastic layer, a heat-insulating layer, or the like.

The fixing belt 22 will now be described in detail.

In FIG. 2, the fixing belt 22 (i.e., a fixing member), which serves as a heat-generating member, is extended under tension and supported by the support roller 23 and the fixing support roller 21.

Figure 3A:
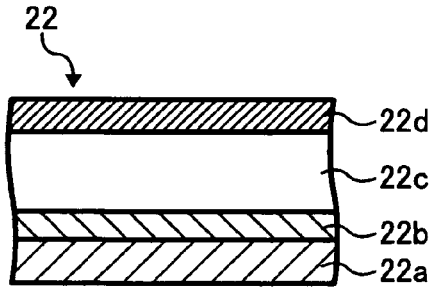
FIGS. 3A to 3D are cross-sectional views of examples of the fixing belt of the fixing device illustrated in FIG. 2.

As illustrated in FIG. 3A, the fixing belt 22 is an endless belt of a multilayer structure, in which a base material 22*a* is sequentially covered by a conductive layer 22*b*, an elastic layer 22*c*, and a releasing layer 22*d*. The base material 22*a* is formed of an insulating, heat-resistant resin material, such as polyimide, polyamide-imide, PEEK (polyether ether ketone), PES (polyether sulfone), PPS (polyphenylene sulfide), and a fluorine resin, for example. The layer thickness of the base material 22*a* is set to be in a range of from approximately 30 micrometers to approximately 200 micrometers in consideration of the heat capacity and the strength of the base material 22*a*.

The conductive layer 22*b* (i.e., a heat-generating layer) of the fixing belt 22 is formed by a magnetic conductive material, and the layer thickness of the conductive later 22*b* is set to be in a range of from approximately 1 micrometers to approximately 20 micrometers. The conductive layer 22*b* is formed on the base material 22*a* by plating, spattering, vacuum vapor deposition, or another method.

The material forming the conductive layer 22*b* may be a magnetic conductive material, such as nickel and stainless steel. In the first embodiment, the material forming the conductive layer 22*b* is a magnetic shunt alloy having a Curie point equal to or higher than the target fixing temperature and equal to or lower than approximately 500 degrees Celsius (preferably, equal to or lower than approximately 300 degrees Celsius). Specifically, the magnetic shunt alloy is an alloy of nickel, iron, and chrome. The Curie point of the magnetic shunt alloy can be set to a desired value by adjusting processing conditions and the amounts of the respective materials forming the magnetic shunt alloy. With the conductive layer 22*b* thus formed by the magnetic conductive material having the Curie point near the fixing temperature of the fixing belt 22, the conductive layer 22*b* can be heated by electromagnetic induction without being overheated. The mechanism of the heating process will be later described in detail.

The elastic layer 22*c* of the fixing belt 22 is formed of a silicone rubber, a phlorosilicone rubber, or the like, and is set to have a layer thickness of from approximately 50 micrometers to approximately 500 micrometers and an Asker hardness of from approximately 5 degrees to approximately 50 degrees. With this configuration, an obtained output image has uniform image quality without uneven luster.

The releasing layer 22*d* of the fixing belt 22 is, for example, a fluorine resin, such as a tetrafluoroethylene resin (PTFE), a tetrafluoroethylene-perfluoroalkyl vinyl ether copolymer resin (PFA), and a tetrafluoroethylene hexafluoropropylene copolymer (FEP), a mixture of the above resins, or one of the above resins dispersed in a heat-resistant resin. The layer thickness of the releasing layer 22*d* is set to be in a range of from approximately 5 micrometers to approximately 50 micrometers (preferably, in a range of from approximately 10 micrometers to approximately 30 micrometers). With this configuration, the releasing ability of the toner carried on the fixing belt 22 and the flexibility of the fixing belt 22 can be securely maintained. Alternatively, a primer layer or the like may be provided between adjacent ones of the respective layers forming the fixing belt 22, i.e., the base material 22*a*, the conductive layer 22*b*, the elastic layer 22*c*, and the releasing layer 22*d*.

In the first embodiment, the fixing belt 22, which serves as the heat-generating member, has a four-layer structure, as illustrated in FIG. 3A. Alternatively, the fixing belt 22 may have one of multilayer structures illustrated in FIGS. 3B to 3D.

Figure 3B:
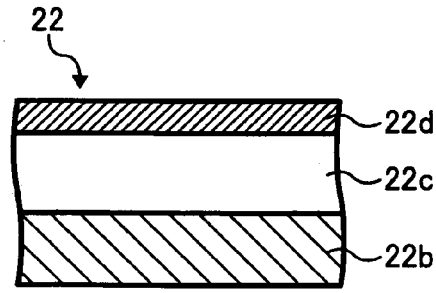

The fixing belt 22 illustrated in FIG. 3B includes the conductive layer 22*b*, the elastic layer 22*c*, and the releasing layer 22*d*. The conductive layer 22*b* may be a resin material, such as polyimide, polyamide-imide, PEEK, PES, PPS, and a fluorine resin, which is dispersed with magnetic conductive particles. In this case, the magnetic conductive particles of from approximately 20 weight percentages to approximately 98 weight percentages is added to the resin material. Specifically, the magnetic conductive particles are dispersed in the resin material in a varnish state by using a dispersing device, such as a roll mill, a sand mill, and a centrifugal defoaming device. The resin material thus dispersed with the magnetic conductive particles is adjusted to have appropriate viscosity by adding a solvent, and then is placed in a mold to be molded into the conductive layer 22*b* of a desired layer thickness.

Figure 3C:
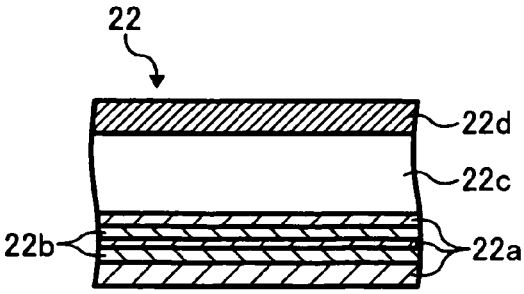

The fixing belt 22 illustrated in FIG. 3C includes a plurality of the conductive layers 22*b* inside the base material 22*a*, and the elastic layer 22*c* and the releasing layer 22*d* are sequentially formed on the base material 22*a*.

Figure 3D:
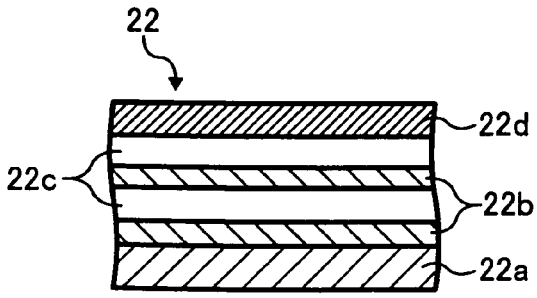

In the fixing belt 22 illustrated in FIG. 3D, the base material 22*a* is covered by the elastic layer 22*c*, which includes a plurality of the conductive layers 22*b*, and the releasing layer 22*d* forms the surface layer of the fixing belt 22.

In the above three cases, similar effects as the effects of the first embodiment can be obtained by configuring the conductive layer 22*b* in a similar manner to the first embodiment.

As illustrated in FIGS. 2 and 4, the induction heating device 24, which serves as an exciting member for generating an alternating magnetic field, includes the coil 25 which is formed into a loop shape.

The coil 25, which serves as the exciting member, is an exciting coil wound once around the front surface and the rear surface (i.e., the outer circumferential surface and the inner circumferential surface) of each of the heat-generating members, i.e., the fixing belt 22 and the support roller 23 such that the coil 25 is not in contact with the heat-generating members. That is, parts of the fixing belt 22 and the support roller 23 are sandwiched by the loop portion of the loop-shaped coil 25. As illustrated in FIG. 4, the coil 25 extends parallel to the width direction of the fixing belt 22 and the support roller 23. One end in the width direction of the coil 25 is folded to surround the inner circumferential surface and the outer circumferential surface (i.e., a principal heat-generating surface) of each of the heat-generating members. Meanwhile, the other end in the width direction of the coil 25 is connected to a high-frequency power supply 40, which applies an alternating current of from approximately 10 kilohertz to approximately 1 megahertz (preferably, from approximately 20 kilohertz to approximately 300 kilohertz) to the coil 25.

The coil 25 is a litz wire formed by twining together a plurality of fine conductive wires each coated with an insulating film. In general, if the diameter of the conductive wire is reduced, energy loss caused by the application of the high-frequency alternating current is reduced, but the strength of the conductive wire is decreased. Thus, the coil 25 tends to have a rupture as it is wounded. Therefore, the coil 25 is preferably formed by the conductive wires each having a wire diameter of equal to or larger than approximately 0.05 millimeters. Further, in consideration of the current flowed through the entirety of the individual conductive wire, the wire diameter of the individual conductive wire is preferably set to be equal to or smaller than two times a penetration depth δ (delta), which is calculated from the frequency of the alternating current applied to the coil 25. The penetration depth δ is obtained by a formula $\delta=503*[\rho/(\mu f)]^{1/2}$, wherein ρ (rho), μ (mu), and f represent the volume resistivity of a material, the relative magnetic permeability of the material, and the frequency of the alternating current which excites the material, respectively.

In the case in which the coil 25 is formed by the litz wire, if the number of the conductive wires forming the litz wire is increased, cross-sectional areas of the litz wire is also increased. Therefore, the amount of withstand current is increased. However, the flexibility of the coil 25 required when being wound is decreased. Further, the occupied area of the coil 25 is increased, which is not preferable in terms of layout of the fixing device 20. In light of the above, in the first embodiment, the coil 25 is formed by twining together 150 conductive wires each having a wire diameter of approximately 0.15 millimeters.

Figure 5:
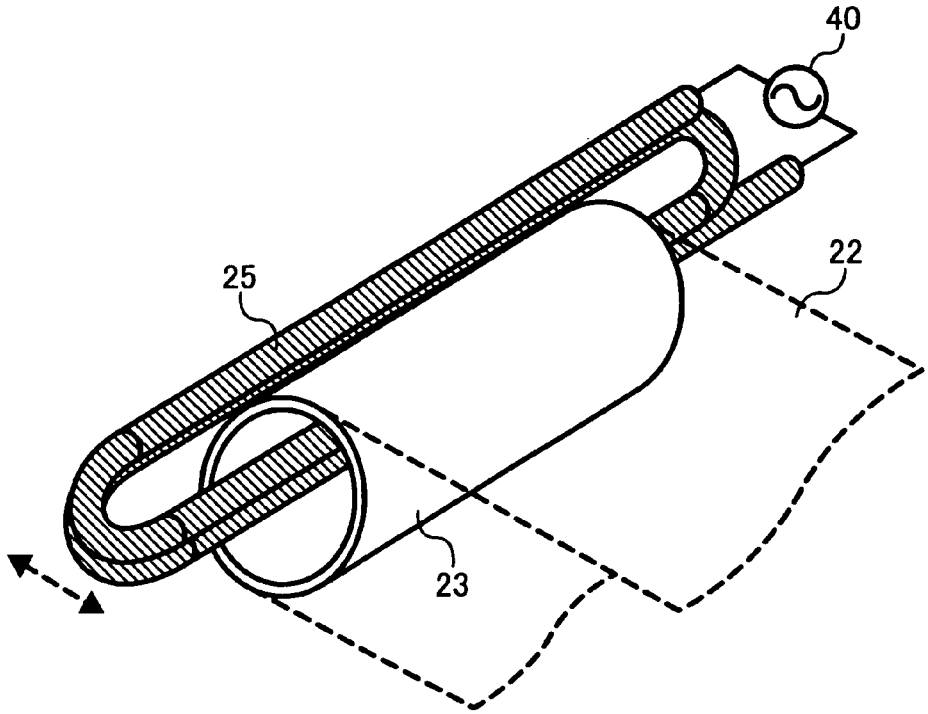
FIG. 5 is a perspective view of another example of the heating device of the fixing device illustrated in FIG. 2.

In the first embodiment, the coil 25 is wound only once (i.e., the winding number is one) around the front surface and the rear surface of each of the fixing belt 22 and the support roller 23, such that the coil 25 sandwiches the fixing belt 22 and the support roller 23 without contacting the fixing belt 22 and the support roller 23. Alternatively, as illustrated in FIG. 5, the coil 25 may be wound a plurality of times around the front surface and the rear surface of each of the fixing belt 22 and the support roller 23, such that the coil 25 sandwiches the fixing belt 22 and the support roller 23 without contacting the fixing belt 22 and the support roller 23. In this case, the winding number of the coil 25 is preferably set to be from approximately one to approximately fifty, and more preferably, from approximately one to approximately ten.

In the first embodiment, the coil 25 is formed by the litz wire. Alternatively, the coil 25 may be formed by a single conductive wire.

Further, to prevent a leaked magnetic field from being formed in an area in which the coil 25 does not face the front surface and the rear surface of each of the fixing belt 22 and the support roller 23, a core may be provided to form a magnetic path. Alternatively, a nonmagnetic, low-resistance conductive cover formed of copper, aluminum, or the like may be provided.

The induction heating device 24 (i.e., the coil 25) thus configured to serve as the exciting member can be moved in directions indicated by broken line arrows G in FIG. 2 (i.e., the radial directions of the support roller 23) by a drive unit 51 which serves as a changing device.

Figure 6A:
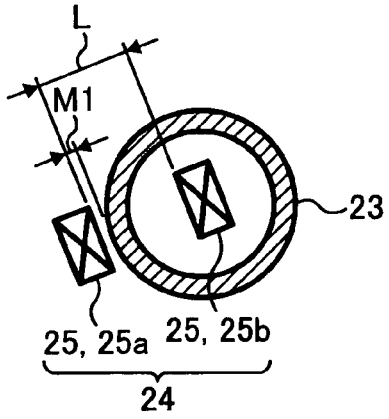
FIGS. 6A to 6C are schematic views illustrating changes in opposing distances of an exciting member of the heating device forming the fixing device illustrated in FIG. 2.
Figure 6B:
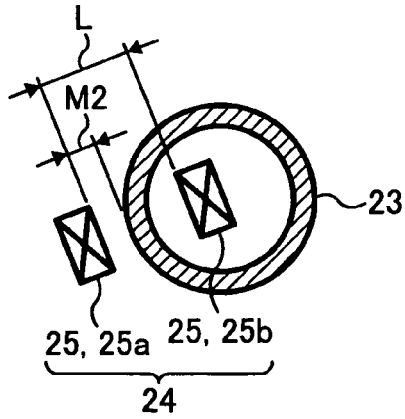
Figure 6C:
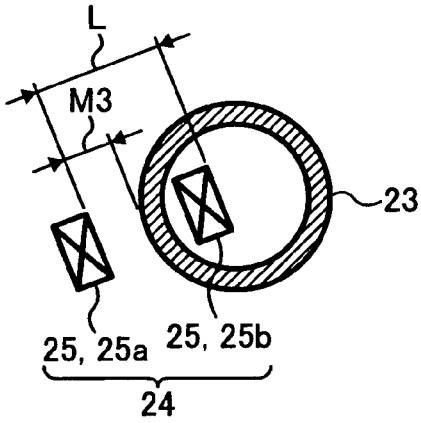

Specifically, as illustrated in FIGS. 6A to 6C, the coil 25 is configured to have a constant value L, which is the sum of an opposing distance of the coil 25 to the front surface (i.e., the primary heat-generating surface) of each of the heat-generating members, i.e., the fixing belt 22 and the support roller 23, and an opposing distance of the coil 25 to the rear surface of each of the heat-generating members. That is, the value L, which represents the distance between a coil portion 25*a* facing the front surface of each of the heat-generating members and a coil portion 25*b* facing the rear surface of each of the heat-generating members, is kept constant.

Further, the opposing distance of the coil 25 to the front surface of each of the heat-generating members (i.e., the fixing belt 22 and the support roller 23) and the opposing distance of the coil 25 to the rear surface of each of the heat-generating members can be changed. In other words, the opposed position of the coil 25 to the front surface of each of the heat-generating members and the opposed position of the coil 25 to the rear surface of each of the heat-generating members can be changed. That is, the opposing distance of the coil portion 25*a* to the front surface of each of the heat-generating members can be changed within a range of from M1 to M3, and the opposing distance of the coil portion 25*b* to the rear surface of each of the heat-generating members can be changed within a range of from (L-M1) to (L-M3). Specifically, when the temperatures of the heat-generating members are relatively low, the opposing distance of the coil portion 25*a* to the front surface of each of the heat-generating members is controlled to be smaller than when the temperatures of the heat-generating members are relatively high. The control of the opposed positions of the coil 25 will be later described in detail.

In FIG. 2, the pressure roller 30 is formed by a cylinder member, which is formed of aluminum, copper, or the like and is covered by an elastic layer formed of a fluoro-rubber, a silicone rubber, or the like. The elastic layer of the pressure roller 30 is set to have a radial thickness of from approximately 1 millimeters to approximately 5 millimeters and an Asker hardness of from approximately 20 degrees to approximately 50 degrees. The pressure roller 30 is in pressure contact with the fixing support roller 21 via the fixing belt 22. The recording medium P is conveyed to a contact area between the fixing belt 22 and the pressure roller 30 (i.e., a fixing nip portion).

At an entry side of the contact area between the fixing belt 22 and the pressure roller 30, the guide plate 35 is provided for guiding the recording medium P to be conveyed.

Meanwhile, at an exit side of the contact area between the fixing belt 22 and the pressure roller 30, the separation plate 36 is provided for guiding the recording medium P to be conveyed and for helping the recording medium P to be separated from the fixing belt 22.

At a position on the outer circumferential surface of the fixing belt 22 and upstream of the fixing nip portion, the thermistor 38 (i.e., a thermosensor) of relatively high thermal responsiveness is in contact with the fixing belt 22. The thermistor 38, which serves as a temperature detecting device (i.e., a detecting device), detects the surface temperature of the fixing belt 22 (i.e., the fixing temperature) to adjust the output of the induction heating device 24.

Further, on the basis of the detected temperature (i.e., a detection result) detected by the thermistor 38 which serves as the temperature detecting device, the drive unit 51 controlled by a control unit 50 changes the opposing distances of the coil 25 to the fixing belt 22 and the support roller 23.

The fixing device 20 configured as described above is operated as follows.

As the fixing support roller 21 is driven to rotate, the fixing belt 22 is rotated in a direction indicated by an arrow H shown in FIG. 2. Further, the support roller 23 is also rotated in the counterclockwise direction, and the pressure roller 30 is rotated in a direction indicated by an arrow I. The fixing belt 22 is heated at a position facing the coil 25 (i.e., a position where the support roller 23 is located).

Specifically, the high-frequency power supply 40 applies a high-frequency alternating current of from approximately 10 kilohertz to approximately 1 megahertz to the coil 25, and magnetic field lines are formed to alternate bi-directionally in the loop of the coil 25. Thereby, an alternating magnetic field is generated. When the temperatures of the support roller 23 and the conductive layer 22*b* of the fixing belt 22 are equal to or lower than the respective Curie points, an overcurrent is generated in the surface of the support roller 23 and the conductive layer 22*b* of the fixing belt 22. Then, Joule heat is generated due to electric resistances of the support roller 23 and the conductive layer 22*b*, and the support roller 23 and the conductive layer 22*b* are heated. Thereby, the fixing belt 22 is heated by the heat generated by the support roller 23 and the heat generated by the conductive layer 22*b* of the fixing belt 22.

Thereafter, the front surface of the fixing belt 22 which has been caused to generate heat by the coil 25 passes the thermistor 38 and reaches the contact area where the fixing belt 22 contacts the pressure roller 30. Then, when the recording medium P is conveyed to the contact area, the toner images T formed on the recording medium P are heated and fused.

Specifically, the recording medium P which has been through the above-described image forming process and carries thereon the toner images T is guided by the guide plate 35 into the nip between the fixing belt 22 and the pressure roller 30. That is, the recording medium P is conveyed in a direction indicated by an arrow Y. Then, the toner images T are fixed on the recording medium P by the heat applied by the fixing belt 22 and the pressure applied by the pressure roller 30, and the recording medium P is sent out from the nip between the fixing belt 22 and the pressure roller 30.

After having passed the pressure roller 30, the front surface of the fixing belt 22 reaches again the position facing the coil 25. The above sequence of operations is continuously repeated, and the fixing process in the image forming process is completed.

In the above-described fixing process, if the temperatures of the support roller 23 and the conductive layer 22*b* exceed the respective Curie points, the heat generation by the support roller 23 and the conductive layer 22*b* is suppressed.

That is, if the temperatures of the support roller 23 and the conductive layer 22*b* exceed the respective Curie points when heated by the induction heating device 24, the support roller 23 and the conductive layer 22*b* lose magnetism. Therefore, generation of overcurrent is suppressed in the vicinity of the surface of the support roller 23. Accordingly, the amount of the Joule heat generated in the support roller 23 and the conductive layer 22*b* is decreased, and the excessive increase in temperature of the fixing member is prevented.

The self-temperature control ability described above is increased particularly in the case in which the coil 25 is shaped into a loop for sandwiching the heat-generating members, i.e., the conductive layer 22*b* and the support roller 23, as in the first embodiment, compared with the case in which the coil 25 is placed to face only the primary heat-generating surface (i.e., the outer circumferential surface) of each of the heat-generating members. An example of experiment showing this effect of increasing the self-temperature control ability will be later described with reference to FIGS. 11A to 13B.

The drive unit 51, which serves as the changing device, adjusts the opposed positions of the coil 25 to the support roller 23 (or to the fixing belt 22) on the basis of the detected temperature detected by the thermistor 38, which serves as the temperature detecting device.

Specifically, if the detected temperature detected by the thermistor 38 is equal to or lower than a predetermined value, the coil 25 is moved to decrease the opposing distance of the coil portion 25*a* to the front surface of the support roller 23 (i.e., M1), as illustrated in FIG. 6A. The detected temperature detected by the thermistor 38 becomes equal to or lower than the predetermined value mainly at the start-up of the fixing device 20, in which the fixing temperature of the fixing belt 22 has not reached the approximate target fixing temperature (i.e., when the fixing temperature of the fixing belt 22 needs to be rapidly increased).

Meanwhile, if the detected temperature detected by the thermistor 38 exceeds the predetermined value, the coil 25 is moved to increase the opposing distance of the coil portion 25*a* to the front surface of the support roller 23 (i.e., M3), as illustrated in FIG. 6C. The coil 25 in the state illustrated in FIG. 6A shifts first to the state illustrated in FIG. 6B, and then to the state illustrated in FIG. 6C. The detected temperature detected by the thermistor 38 exceeds the predetermined value mainly after the start-up of the fixing device 20 when the fixing temperature of the fixing belt 22 has reached the approximate target fixing temperature (i.e., when the fixing temperature of the fixing belt 22 does not need to be rapidly increased).

As described above, the coil 25 is placed to sandwich the front surface and the rear surface of each of the heat-generating members, i.e., the fixing belt 22 and the support roller 23, such that the coil 25 is not in contact with the heat-generating members. Further, the opposed positions (i.e., the opposing distances) of the coil 25 to the heat-generating members are changed. Therefore, even if each of the heat-generating members has a single-layer structure, a heating stop temperature thereof (i.e., a temperature at which the gradient of increase in temperature is substantially zero) can be changed with no need to change the frequency of the alternating current. Specifically, in a state in which the coil 25 is located at a position illustrated in FIG. 6A, magnetic fluxes passing through the heat-generating members are increased and the heating stop temperatures of the heat-generating members are increased, compared with a state in which the coil 25 is located at a position illustrated in FIG. 6*c*.

Therefore, when the surface temperature of the fixing belt 22 is relatively low and thus needs to be rapidly increased, the coil 25 is moved to the position illustrated in FIG. 6A. Thereby, the heat-generating members obtain such heat that causes the surface temperature of the fixing belt 22 to overshoot and exceed the target fixing temperature, and the surface temperature of the fixing belt 22 is increased in a relatively short time period. In particular, in a case in which the image forming apparatus 1 (i.e., the fixing device 20) is started up after the image forming apparatus 1 has been left unused for a relatively long time, for example, the heat quantity consumed by components surrounding the fixing device 20 is increased as the fixing device 20 is started up. In this case, therefore, the control operation described above is effective.

Meanwhile, when the surface temperature of the fixing belt 22 has reached the approximate target fixing temperature and thus does not need to be rapidly increased, the coil 25 is moved to the position illustrated in FIG. 6C. Thereby, through the self-temperature control operation of the heat-generating members, the heating stop temperature of each of the heat-generating members is decreased from the heating stop temperature in the state illustrated in FIG. 6A. That is, the position of the coil 25 illustrated in FIG. 6C is set such that the heating stop temperature of each of the heat-generating members at the position is a temperature preventing the excessive increase in temperature of the fixing member.

An example of an experiment showing this effect of changing the heating stop temperature by changing the opposed positions of the coil 25 will be later described with reference to FIG. 14.

As described above, in the fixing device 20 using the electromagnetic induction heating method of the first embodiment, the coil 25 is placed to sandwich the front surface and the rear surface of each of the heat-generating members, i.e., the fixing belt 22 and the support roller 23, such that the coil 25 is not in contact with the heat-generating members. Further, the opposing distances M1 to M3 of the coil 25 to the heat-generating members can be changed. Accordingly, the self-temperature control ability of the heat-generating members can be increased. Further, the heating stop temperatures of the heat-generating members can be changed. It is therefore possible to easily and securely prevent the excessive increase in temperature of the fixing member through the self-temperature control of the heat-generating members without slowing the start-up of the fixing device 20. It is further possible to provide the heat-generating members of a relatively simple structure and to prevent the heat-generating members from having such problems as a rupture.

In the first embodiment, the fixing belt 22 including the conductive layer 22*b* and the support roller 23 including a conductive layer are used as the heat-generating members. Alternatively, only either one of the fixing belt 22 and the support roller 23 may be used as the heat-generating member. In this case, similar effects to the effects of the first embodiment can be obtained by providing the either one of the fixing belt 22 and the support roller 23 used as the heat-generating member with a similar conductive layer to the conductive layer used in the first embodiment, and by causing the loop-shaped coil 25 to sandwich the heat-generating member and changing the opposing distances of the coil 25 to the heat-generating member.

In particular, when only the support roller 23 is used as the heat-generating member, the conductive layer 22*b* of the fixing belt 22 is unnecessary, and the support roller 23 has a single-layer structure (i.e., a structure solely including the conductive layer). Therefore, the structure of the fixing device 20 as a whole is further simplified.

Further, in the first embodiment, the temperature of the fixing belt 22 which serves as the heat-generating member is directly detected by the thermistor 38, and the drive unit 51 is controlled to change the opposing distances of the coil 25 to the heat-generating member on the basis of the thus directly detected temperature. Alternatively, the temperature of the heat-generating member may be indirectly detected, and the drive unit 51 may be controlled to change the opposing distances of the coil 25 to the heat-generating member on the basis of the thus indirectly detected temperature. In this case, too, similar effects to the effects of the first embodiment can be obtained.

Figure 7A:
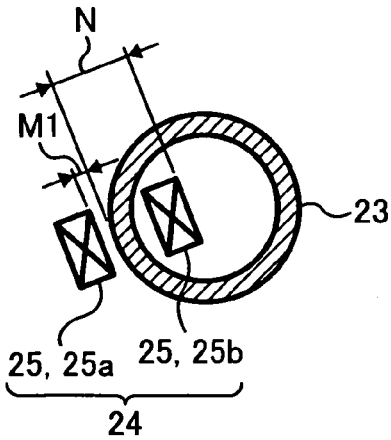
FIGS. 7A and 7B are schematic views illustrating changes in an opposing distance of an exciting member of a heating device forming a fixing device according to a second embodiment of the present invention.
Figure 7B:
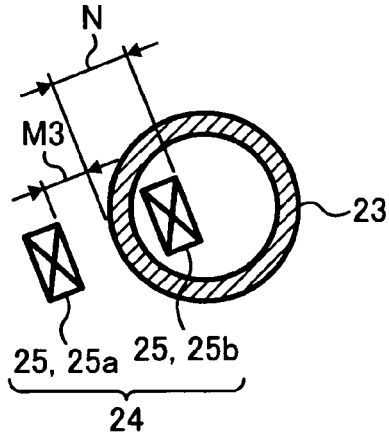

With reference to FIGS. 7A and 7B, a second embodiment of the present invention will now be described.

FIGS. 7A and 7B are schematic views illustrating changes in the opposing distance of the coil 25 to the heat-generating members in a fixing device 20*b* according to the second embodiment, as opposed to FIGS. 6A to 6C illustrating the changes in the opposing distances of the coil 25 to the heat-generating members in the fixing device 20 according to the first embodiment. The fixing device 20*b* according to the second embodiment is different from the fixing device 20 according to the first embodiment in that only the opposing distance of the coil 25 to the front surface (i.e., the primary heat-generating surface) of each of the heat-generating members is changed, unlike the fixing device 20 according to the first embodiment in which the opposing distance of the coil 25 to the front surface of each of the heat-generating members and the opposing distance of the coil 25 to the rear surface of each of the heat-generating members are both changed.

Similar to the fixing device 20 according to the first embodiment, the fixing device 20*b* according to the second embodiment includes the fixing support roller 21, the fixing belt 22, the support roller 23, the induction heating device 24, the pressure roller 30, and the thermistor 38, for example.

Further, similar to the fixing device 20 according to the first embodiment, the fixing device 20*b* according to the second embodiment also includes the heating device according to the electromagnetic induction heating method. Furthermore, the coil 25 is placed to sandwich the front surface and the rear surface of each of the heat-generating members, i.e., the fixing belt 22 and the support roller 23 each having a desired Curie point, such that the coil 25 is not in contact with the heat-generating members.

Unlike the fixing device 20 according to the first embodiment, in the fixing device 20*b* according to the second embodiment, only the opposing distance of the coil 25 to the front surface, i.e., the primary heat-generating surface, of each of the heat-generating members is changed by a drive unit which serves as a changing device. That is, the opposing distance of the coil portion 25*a* to the front surface of each of the heat-generating members is changed within a range of from M1 to M3, while an opposing distance N of the coil portion 25*b* to the rear surface of each of the heat-generating members is kept constant. A drive mechanism for changing only the opposing distance of the coil portion 25*a* to the front surface of each of the heat-generating members may include, for example, a mechanism for moving the front-side coil portion 25*a* in the radial directions of the support roller 23, a mechanism for fixedly supporting the back-side coil portion 25*b*, and a coil for connecting the coil portions 25*a* and 25*b* and extending and contracting in the radial directions of the support roller 23.

On the basis of the detected temperature detected by the thermistor 38 (i.e., the temperature detecting device), the drive unit, which serves as the changing device, adjusts the opposing distance of the coil portion 25*a* to the support roller 23 (or to the fixing belt 22).

Specifically, if the detected temperature detected by the thermistor 38 is equal to or lower than a predetermined value, the coil portion 25*a* is moved to decrease the opposing distance of the coil portion 25*a* to the front surface of the support roller 23 (i.e., M1), as illustrated in FIG. 7A. The detected temperature detected by the thermistor 38 becomes equal to or lower than the predetermined value when the fixing temperature of the fixing belt 22 has not reached an approximate target fixing temperature.

Meanwhile, if the detected temperature detected by the thermistor 38 exceeds the predetermined value, the coil portion 25*a* is moved to increase the opposing distance of the coil portion 25*a* to the front surface of the support roller 23 (i.e., M3), as illustrated in FIG. 7B. The detected temperature detected by the thermistor 38 exceeds the predetermined value when the fixing temperature of the fixing belt 22 has reached the approximate target fixing temperature.

As described above, the coil 25 is placed to sandwich the front surface and the rear surface of each of the heat-generating members, i.e., the fixing belt 22 and the support roller 23, such that the coil 25 is not in contact with the heat-generating members. Further, the opposed position of the coil 25 (i.e., the front-side coil portion 25*a*) to the heat-generating members is changed. Thereby, even if each of the heat-generating members has a single-layer structure, the heating stop temperature of each of the heat-generating members can be changed, with no need to change the frequency of the alternating current. Specifically, in a state in which the front-side coil portion 25*a* is at a position illustrated in FIG. 7A, magnetic fluxes passing through the heat-generating members are increased and the heating stop temperatures of the heat-generating members are increased, compared with a state in which the front-side coil portion 25*a* is located at a position illustrated in FIG. 7B.

As described above, similar to the first embodiment, according to the configuration of the second embodiment, the self-temperature control ability of each of the heat-generating members, i.e., the fixing belt 22 and the support roller 23 can be increased. Further, the heating stop temperatures of the heat-generating members can be changed. It is therefore possible to easily and securely prevent the excessive increase in temperature of the fixing member through the self-temperature control of the heat-generating members without slowing the start-up of the fixing device 20*b*. It is further possible to provide the heat-generating members of a relatively simple structure and to prevent the heat-generating members from having such problems as a rupture.

Figure 8:
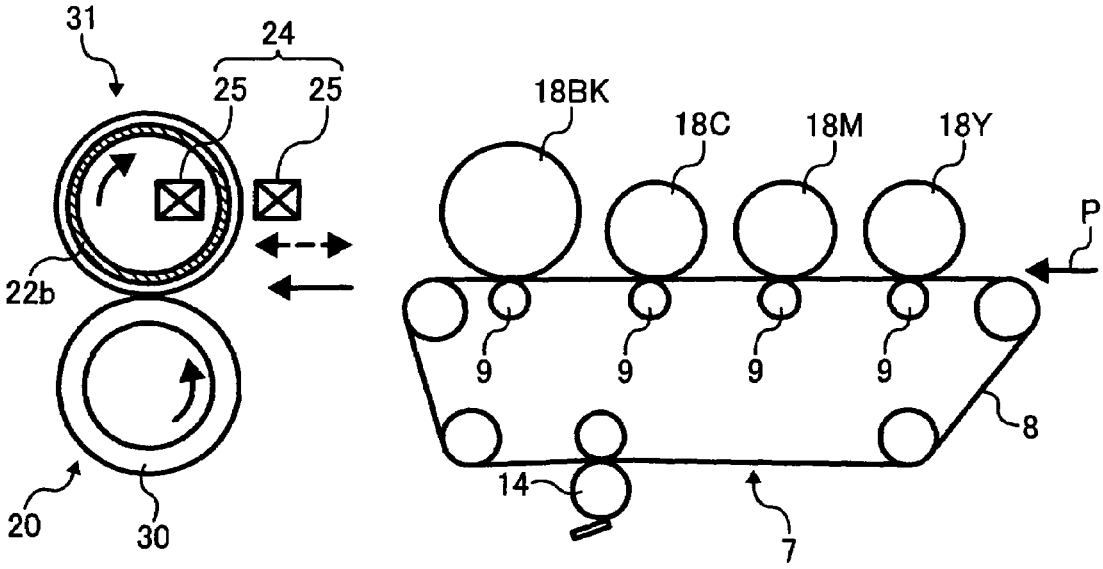
FIG. 8 is a configuration view of relevant parts of an image forming apparatus according to a third embodiment of the present invention.

With reference to FIG. 8, a third embodiment of the present invention will now be described in detail.

FIG. 8 is a cross-sectional view illustrating relevant parts of an image forming apparatus 1*c* according to the third embodiment. The image forming apparatus 1*c* according to the third embodiment is different from the image forming apparatus 1 according to the first embodiment in that the image forming apparatus 1*c* is a tandem-type, color image forming apparatus, and that a fixing roller 31 is used as a heat-generating member.

As described above, the image forming apparatus 1*c* is the tandem-type, color image forming apparatus. As illustrated in FIG. 8, a plurality of photoconductor drums 18BK, 18C, 18M, and 18Y are juxtaposed on a transfer belt 8 in an image forming unit of the image forming apparatus 1*c*. Although not illustrated, a charging unit, an exposure unit, a development unit, a cleaning unit, and an electricity removing unit are provided around the outer circumferential surface of each of the plurality of the photoconductor drums 18BK, 18C, 18M, and 18Y, similarly to the configuration of the process cartridge 4 illustrated in FIG. 1. On the respective photoconductor drums 18BK, 18C, 18M, and 18Y, toner images of respective colors, i.e., black, cyan, magenta, and yellow are formed.

A transfer unit 7*c* includes the transfer belt 8 for conveying the recording medium P, bias rollers 9 facing the respective photoconductor drums 18BK, 18C, 18M, and 18Y via the transfer belt 8, a cleaning roller 14 for cleaning a surface of the transfer belt 8, and so forth.

The recording medium P conveyed in a direction indicated by an arrow J is sequentially conveyed by the transfer belt 8 to respective positions facing the photoconductor drums 18Y, 18M, 18C, and 18BK. In this process, the toner images of the respective colors are transferred in superimposition onto the recording medium P as transfer bias voltages are applied by the bias rollers 9. Thereby, a full-color toner image is formed on the recording medium P. The recording medium P thus formed with the full-color toner-image is then separated from the transfer belt 8 and conveyed toward a fixing device 20*c*.

The fixing device 20*c* according to the third embodiment mainly includes the fixing roller 31 (i.e., a fixing member) which serves as the heat-generating member, the pressure roller 30, and the induction heating device 24.

The fixing roller 31 includes the conductive layer 22*b* formed of a magnetic conductive material, an elastic layer formed of a silicone rubber or the like, and a releasing layer formed of a fluorine compound or the like, for example. Similarly to the first embodiment, the conductive layer 22*b* of the fixing roller 31 is formed of a magnetic shunt alloy having a Curie point equal to or higher than a target fixing temperature and equal to or lower than approximately 500 degrees Celsius. The fixing roller 31 has mechanical strength withstanding the pressure applied by the pressure roller 30.

Further, similarly to the first embodiment, the induction heating device 24 includes the coil 25 which is formed into a loop shape. That is, the coil 25 is placed to sandwich the front surface and the rear surface (i.e., the inner circumferential surface and the outer circumferential surface) of the fixing roller 31, without contacting the fixing roller 31.

The coil 25 is applied with an alternating current of from approximately 10 kilohertz to approximately 1 megahertz, and an alternating magnetic field is generated in the loop of the coil 25. Thereby, the fixing roller 31 is subjected to the electromagnetic induction heating, and heats and fuses the toner image formed on the recording medium P which has been conveyed in the direction indicated by the arrow J. Accordingly, the toner image is fixed on the recording medium P.

The coil 25 (i.e., the induction heating device 24), which serves as an exciting member, is located at an upstream position of a fixing nip portion, i.e., at an upstream position of the fixing nip portion in the rotation direction of the fixing roller 31 (i.e., the heat-generating member). Therefore, the coil 25 (i.e., the induction heating device 24) can promptly respond to a change in temperature of the fixing nip portion.

Further, similarly to the fixing device 20 according to the first embodiment, in the fixing device 20*c* according to the third embodiment, a drive unit which serves as a changing device moves the induction heating device 24 (i.e., the coil 25) in a direction indicated by broken line arrows (i.e., the radial directions of the fixing roller 31) on the basis of a detected temperature detected by a thermistor (i.e., a temperature detecting device).

As described above, similarly to the first embodiment, according to the configuration of the third embodiment, the self-temperature control ability of the fixing roller 31 (i.e., the heat-generating member) can be increased. Further, the heating stop temperature of the fixing roller 31 can be changed. It is therefore possible to easily and securely prevent the excessive increase in temperature of the fixing member through the self-temperature control of the fixing roller 31 without slowing the start-up of the fixing device 20*c*. It is further possible to provide the fixing roller 31 (i.e., the heat-generating member) of a relatively simple structure and to prevent the fixing roller 31 from having such problems as a rupture.

Figure 9:
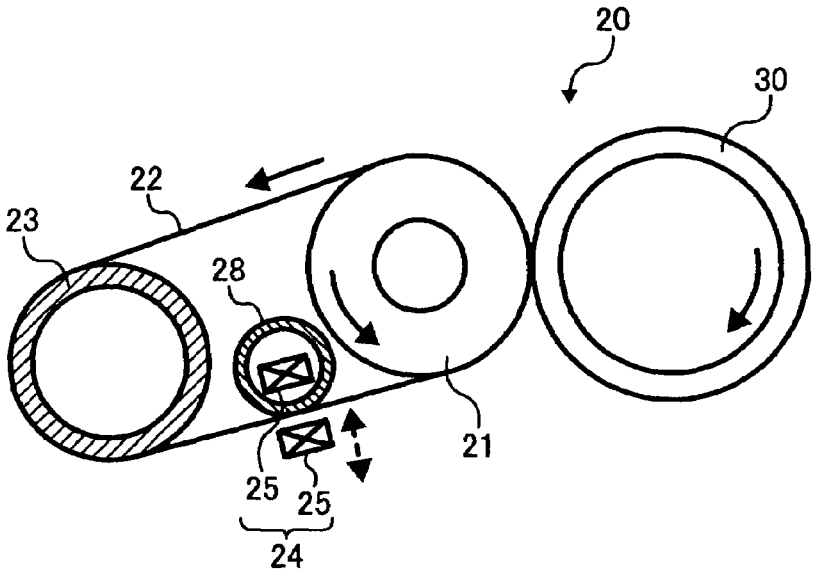
FIG. 9 is a cross-sectional view of a fixing device according to a fourth embodiment of the present invention.

With reference to FIG. 9, a fourth embodiment of the present invention will now be described in detail.

FIG. 9 is a cross-sectional view of a fixing device 20*d* according to the fourth embodiment, as opposed to FIG. 2 illustrating the fixing device 20 according to the first embodiment. The fixing device 20*d* according to the fourth embodiment is different in the position of the induction heating device 24 from the fixing device 20 according to the first embodiment.

The fixing device 20*d* according to the fourth embodiment mainly includes a fixing belt 22*d* (i.e., a fixing member), a heating roller 28 (i.e., a heating member), the induction heating device 24, the support roller 23, and the pressure roller 30.

Similarly to the support roller 23 of the first embodiment, the heating roller 28 is formed of a magnetic shunt alloy having a Curie point equal to or higher than a target fixing temperature and equal to or lower than approximately 500 degrees Celsius. The heating roller 28 is located at an upstream position of a fixing nip portion (i.e., at an upstream position of the fixing nip portion in the moving direction of the fixing belt 22*d*), and is in contact with the inner circumferential surface of the fixing belt 22*d* with predetermined pressure.

As illustrated in FIG. 9, the induction heating device 24 according to the fourth embodiment is formed by the loop-shaped coil 25 which is provided at a position facing the outer circumferential surface and the inner circumferential surface of a part of the fixing belt 22*d* extending between the support roller 23 and the fixing support roller 21. That is, the coil 25 is placed to sandwich the front surface and the rear surface of each of the fixing belt 22*d* and the heating roller 28, such that the coil 25 is not in contact with the fixing belt 22*d* and the heating roller 28.

In the thus configured fixing device 20*d*, the loop-shaped coil 25 is applied with an alternating current of from approximately 10 kilohertz to approximately 1 megahertz. Thereby, an alternating magnetic field is generated in a space formed by the coil 25 which sandwiches the fixing belt 22*d* and the heating roller 28, and the heating roller 28 is subjected to the electromagnetic induction heating. The fixing belt 22*d* according to the fourth embodiment does not include a conductive layer. Therefore, the fixing belt 22*d* receives heat from the heating roller 28, and the temperature of the fixing belt 22*d* is increased to reach a desired fixing temperature.

Further, similarly to the fixing device 20 according to the first embodiment, in the fixing device 20*d* according to the fourth embodiment, a drive unit which serves as a changing device moves the induction heating device 24 (i.e., the coil 25) in a direction indicated by broken line arrows (i.e., the radial directions of the heating roller 28) on the basis of a detected temperature detected by a thermistor (i.e., a temperature detecting device).

As described above, similarly to the first embodiment, according to the configuration of the fourth embodiment, the self-temperature control ability of the heating roller 28 (i.e., a heat-generating member) can be increased. Further, the heating stop temperature of the heating roller 28 can be changed. It is therefore possible to easily and securely prevent the excessive increase in temperature of the fixing member through the self-temperature control of the heating roller 28 without slowing the start-up of the fixing device 20*d*. It is further possible to provide the heating roller 28 (i.e., the heat-generating member) of a relatively simple structure and to prevent the heating roller 28 from having such problems as a rupture.

Figure 10:
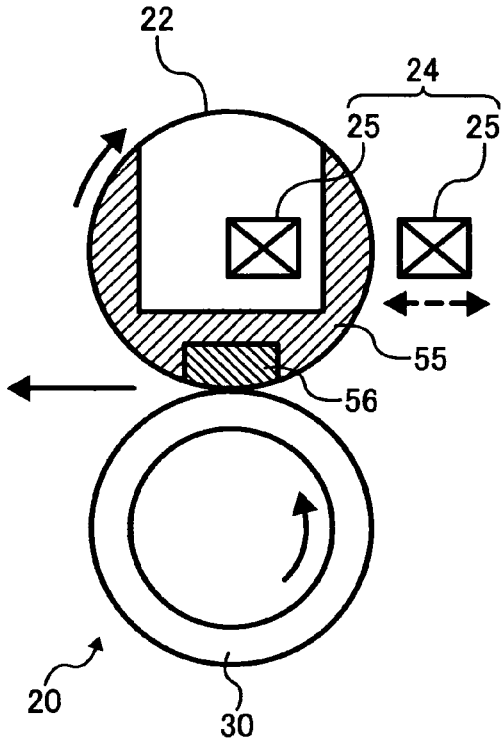
FIG. 10 is a cross-sectional view of a fixing device according to a fifth embodiment of the present invention.

With reference to FIG. 10, a fifth embodiment of the present invention will now be described in detail.

FIG. 10 is a cross-sectional view of a fixing device 20*e* according to the fifth embodiment. The fixing device 20*e* according to the fifth embodiment is different from the fixing device 20*c* according to the third embodiment in that a cylinder-shaped fixing belt 22*e* is used as a fixing member facing the induction heating device 24, while the fixing roller 31 is used as the fixing member facing the induction heating device 24 in the fixing device 20*c* according to the third embodiment.

The fixing device 20*e* according to the fifth embodiment mainly includes the fixing belt 22*e* (i.e., the fixing member) which serves as a heat-generating member, a retentive member 55 provided on the inner side of the fixing belt 22*e* to retain the fixing belt 22*e*, an elastic member 56 provided inside the fixing belt 22*e* to form a desired fixing nip portion, the induction heating device 24 which serves as an exciting member, and the pressure roller 30. Similarly to the fixing belt 22 of the first embodiment, the fixing belt 22*e* of the fifth embodiment includes a conductive layer having a desired Curie point.

Further, similarly to the first embodiment, the induction heating device 24 is formed by the loop-shaped coil 25. That is, the coil 25 is placed to sandwich the front surface and the rear surface of the fixing belt 22*e*, such that the coil 25 is not in contact with the fixing belt 22*e*.

When the coil 25 is applied with an alternating current of from approximately 10 kilohertz to approximately 1 megahertz, an alternating magnetic field is generated in the loop space formed by the coil 25. Thereby, the fixing belt 22*e* is subjected to the electromagnetic induction heating, and heats and fuses the toner image formed on the recording medium P which has been conveyed in a direction indicated by an arrow O. Accordingly, the toner image is fixed on the recording medium P.

The coil 25 (i.e., the induction heating device 24), which serves as the exciting member, is located at an upstream position of a fixing nip portion, i.e., at an upstream position of the fixing nip portion in the rotation direction of the fixing belt 22*e* (i.e., the heat-generating member). Therefore, the coil 25 (i.e., the induction heating device 24) can promptly respond to a change in temperature of the fixing nip portion.

Further, similarly to the fixing device 20 according to the first embodiment, in the fixing device 20*e* according to the fifth embodiment, a drive unit which serves as a changing device moves the induction heating device 24 (i.e., the coil 25) in a direction indicated by broken line arrows (i.e., the radial directions of the fixing belt 22*e*) on the basis of a detected temperature detected by a thermistor (i.e., a temperature detecting device).

As described above, similarly to the first embodiment, according to the configuration of the fifth embodiment, the self-temperature control ability of the fixing belt 22*e* (i.e., the heat-generating member) can be increased. Further, the heating stop temperature of the fixing belt 22*e* can be changed. It is therefore possible to easily and securely prevent the excessive increase in temperature of the fixing member through the self-temperature control of the fixing belt 22*e* without slowing the start-up of the fixing device 20*e*. It is further possible to provide the fixing belt 22*e* (i.e., the heat-generating member) of a relatively simple structure and to prevent the fixing belt 22*e* from having such problems as a rupture.

With reference to FIGS. 11A to 14, description will now be made of examples of experiments performed to examine the effects of the respective embodiments described above.

With reference to FIGS. 11A to 13B, description will be first made of an experiment to examine the effect of increasing the self-temperature control ability of a heat-generating member by placing an exciting member to sandwich the front surface and the rear surface of the heat-generating member without contacting the heat-generating member.

Figure 11A:
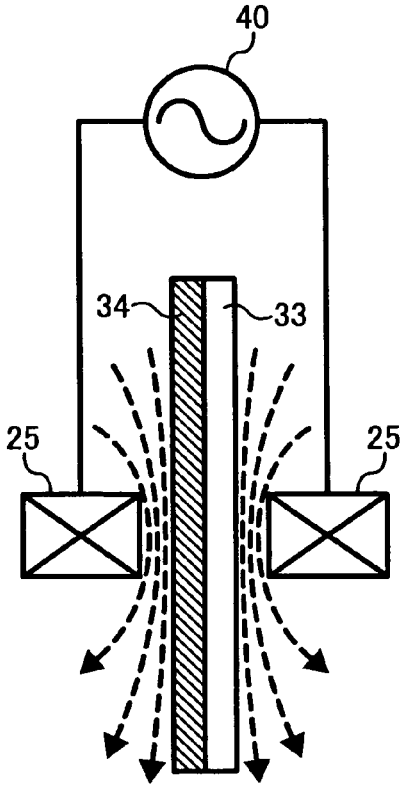
FIGS. 11A and 11B are schematic views of experimental apparatuses used to examine an effect of the embodiments.
Figure 11B:
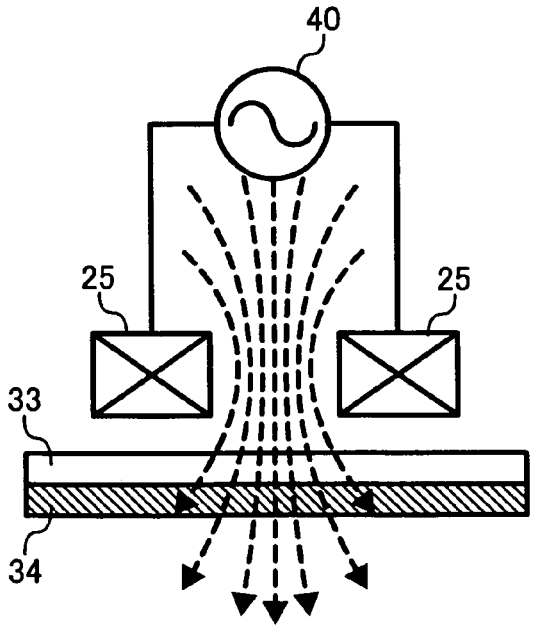

FIGS. 11A and 11B are schematic views of experimental apparatuses. In the experimental apparatus illustrated in FIG. 11A, the coil 25 is placed to sandwich the front surface and the rear surface of a test piece which includes a conductive layer 33 such that the coil 25 is not in contact with the test piece. The test piece corresponds to the heat-generating member used in each of the embodiments. The above configuration corresponds to the configuration of the fixing device of each of the embodiments. Meanwhile, in the experimental apparatus illustrated in FIG. 11B, the coil 25 is placed to face the primary heat-generating surface of the test piece which includes the conductive layer 33. This configuration corresponds to the configuration of the background fixing device.

The experimental apparatuses illustrated in FIGS. 11A and 11B are the same in the configuration of the coil 25 and different only in the direction of the test piece facing the coil 25.

In the experiment, three types of test pieces were prepared, i.e., a first test piece solely including the conductive layer 33, a second test piece including the conductive layer 33 covered with a nonmagnetic conductive layer 34 which is formed of aluminum having a thickness of approximately 0.3 millimeters, and a third test piece including the conductive layer 33 covered with a nonmagnetic conductive layer 34 which is formed of aluminum having a thickness of approximately 0.8 millimeters. In each of the test pieces, the front surface and the rear surface of the conductive layer 33 each have an area of approximately 25 millimeters times approximately 50 millimeters. Further, the conductive layer 33 has a thickness of approximately 0.22 millimeters, and is formed of a magnetic shunt alloy having a Curie temperature of approximately 240 degrees Celsius. Similarly, in each of the test pieces, the front surface and the rear surface of the nonmagnetic conductive layer 34 are each set to have an area of approximately 25 millimeters times approximately 50 millimeters.

In the thus configured experimental apparatuses, the coil 25 is applied with two types of alternating currents by the high-frequency power supply 40, i.e., an alternating current of from approximately 200 watts to approximately 1200 watts having an exciting frequency of approximately 36 kilohertz, and an alternating current of from approximately 200 watts to approximately 1200 watts having an exciting frequency of approximately 130 kilohertz. Thereby, magnetic field lines are generated near the coil 25, as illustrated in FIGS. 11A and 11B.

FIGS. 12A to 13B are graphs representing results of the experiment performed by using the experimental apparatuses described above. In each of the graphs of FIGS. 12A to 13B, a horizontal axis indicates the time elapsed since the start of the electromagnetic induction, and a vertical axis indicates the temperature of a surface of the conductive layer 33.

Figure 12A:
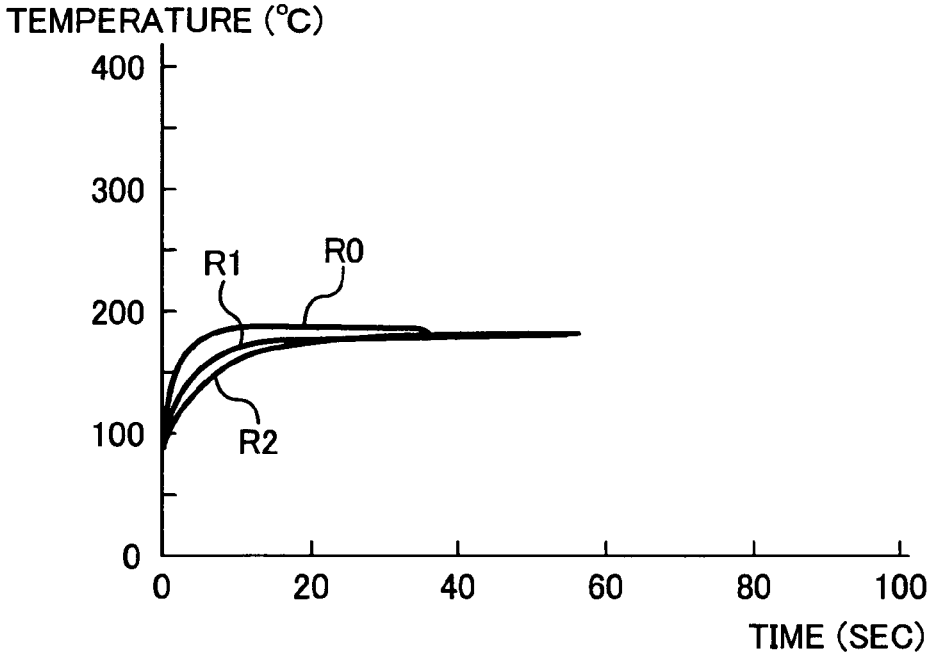
FIGS. 12A and 12B are graphs representing experimental results obtained by using the experimental apparatuses illustrated in FIGS. 11A and 11B.
Figure 12B:
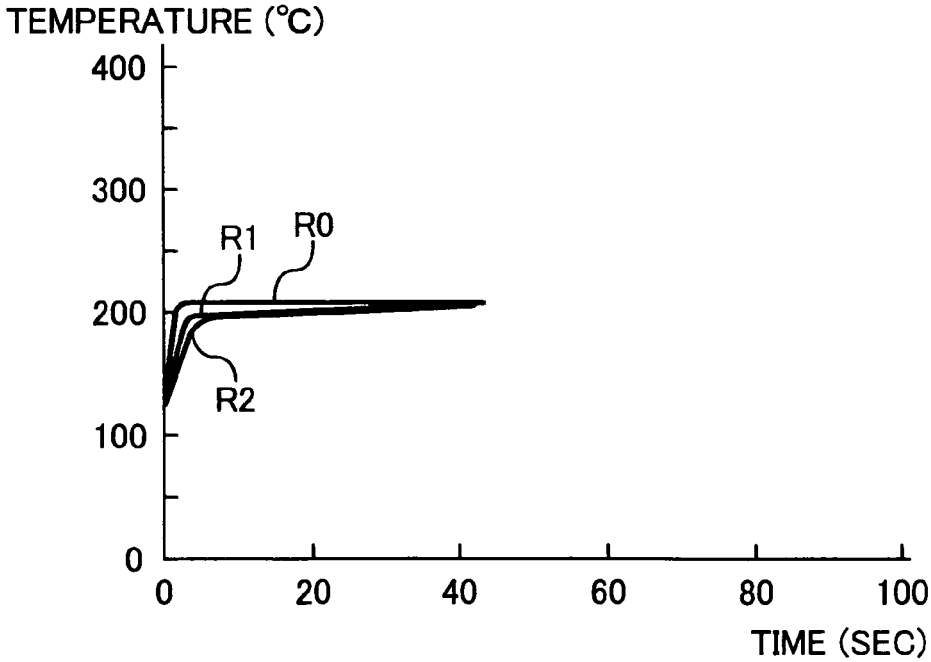
Figure 13A:
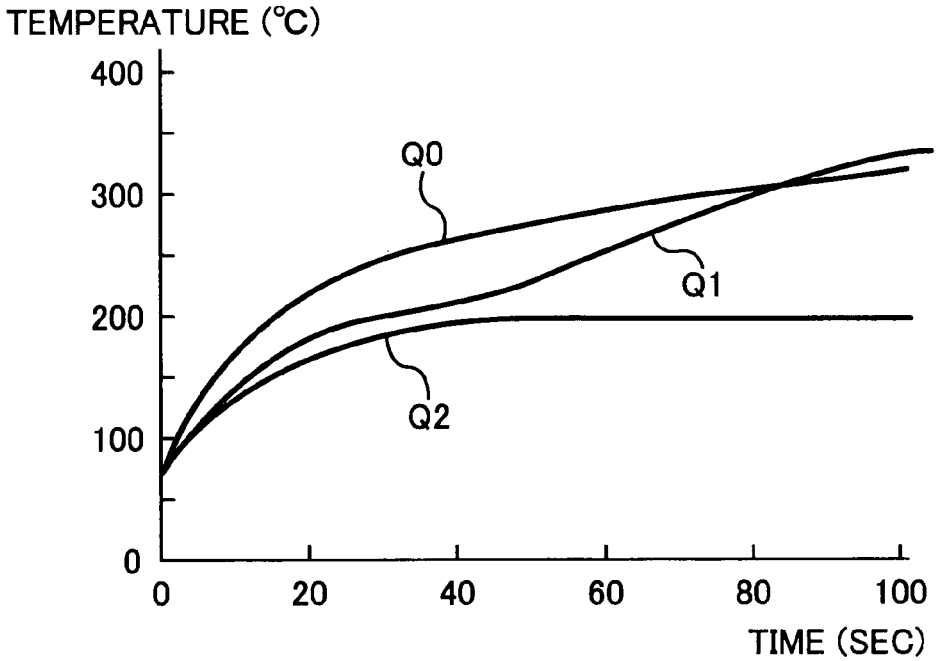
FIGS. 13A and 13B are graphs representing other experimental results obtained by using the experimental apparatuses illustrated in FIGS. 11A and 11B.
Figure 13B:
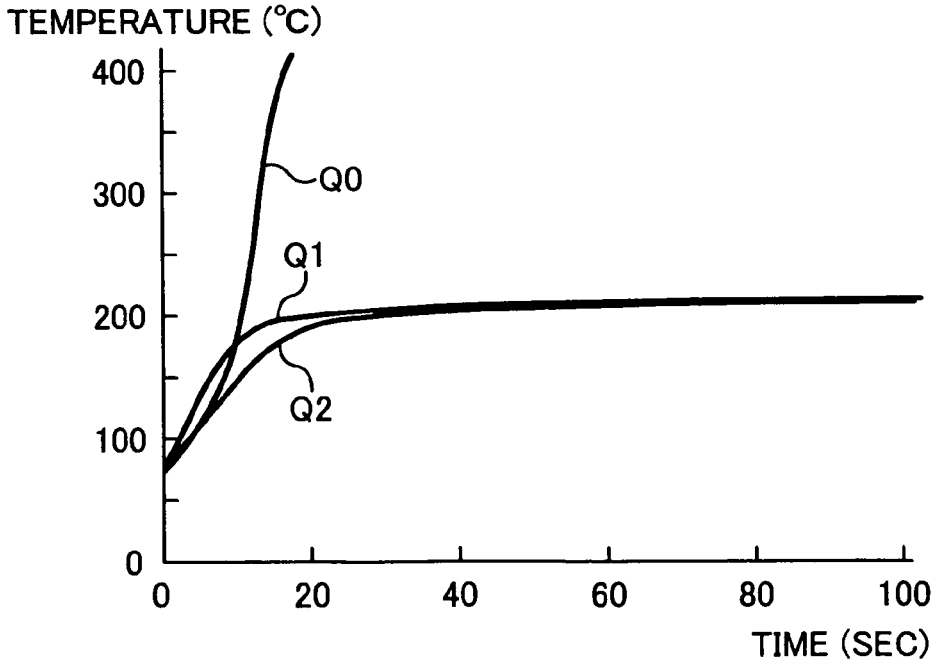

FIGS. 12A and 12B represent the experimental results obtained by using the experimental apparatus illustrated in FIG. 11A, while FIGS. 13A and 13B represent the experimental results obtained by using the experimental apparatus illustrated in FIG. 11B.

FIG. 12A is a graph representing a relationship between the time and the temperature, when the frequency of the alternating current output by the high-frequency power supply 40 was set to be approximately 36 kilohertz. Meanwhile, FIG. 12B is a graph representing a relationship between the time and the temperature, when the frequency of the alternating current output by the high-frequency power supply 40 was set to be approximately 130 kilohertz. In FIGS. 12A and 12B, a solid line R0 represents a result obtained by using the first test piece, which is formed solely by the conductive layer 33. A solid line R1 represents a result obtained by using the second test piece, which is formed by the conductive layer 33 covered with the nonmagnetic conductive layer 34 having the thickness of approximately 0.3 millimeters. A solid line R2 represents a result obtained by using the third test piece, which is formed by the conductive layer 33 covered with the nonmagnetic conductive layer 34 having the thickness of approximately 0.8 millimeters.

FIG. 13A is a graph representing a relationship between the time and the temperature, when the frequency of the alternating current output by the high-frequency power supply 40 was set to be approximately 36 kilohertz. Meanwhile, FIG. 13B is a graph representing a relationship between the time and the temperature, when the frequency of the alternating current output by the high-frequency power supply 40 was set to be approximately 130 kilohertz. In FIGS. 13A and 13B, a solid line Q0 represents a result obtained by using the first test piece, which is formed solely by the conductive layer 33. A solid line Q1 represents a result obtained by using the second test piece, which is formed by the conductive layer 33 covered with the nonmagnetic conductive layer 34 having the thickness of approximately 0.3 millimeters. A solid line Q2 represents a result obtained by using the third test piece, which is formed by the conductive layer 33 covered with the nonmagnetic conductive layer 34 having the thickness of approximately 0.8 millimeters.

It is observed from FIGS. 12A and 12B that, when the temperature of the conductive layer 33 reaches the Curie point, the excessive increase in temperature of the conductive layer 33 over the Curie point is prevented, irrespective of presence or absence of the nonmagnetic conductive layer 34 and the frequency of the alternating current.

Meanwhile, it is observed from FIG. 13A that, when the exciting frequency is set to be approximately 36 kilohertz, the excessive increase in temperature of the conductive layer 33 cannot be prevented unless the conductive layer 33 is provided with the nonmagnetic conductive layer 34 having the thickness of equal to or larger than approximately 0.8 millimeters. Similarly, it is observed from FIG. 13B that, when the exciting frequency is set to be approximately 130 kilohertz, the excessive increase in temperature of the conductive layer 33 cannot be prevented unless the conductive layer 33 is provided with the nonmagnetic conductive layer 34 having the thickness of equal to or larger than approximately 0.3 millimeters. That is, in the case in which the coil 25 is placed to face the primary heat-generating surface of the heat-generating member (i.e., the conductive layer 33), a nonmagnetic conductive layer of relatively low resistivity needs to be provided on the opposite side of the primary heat-generating surface.

It is understood from the above that the self-temperature control ability of the heat-generating member can be increased by inserting the heat-generating member in the space formed by the loop-shaped coil 25 to be sandwiched by the coil 25. It is further understood from comparison of FIGS. 12A and 12B with FIGS. 13A and 13B that the heat generation efficiency (i.e., the start-up) of the heat-generating member is improved by inserting the heat-generating member in the space formed by the loop-shaped coil 25 to be sandwiched by the coil 25. Since the above effects can be obtained with no need to provide the heat-generating member with the nonmagnetic conductive layer 34, the structure of the heat-generating member can be simplified. Therefore, the heat-generating member having no troubles caused by provision of the conductive layer, such as separation of layers, can be provided at a low cost.

Figure 14:
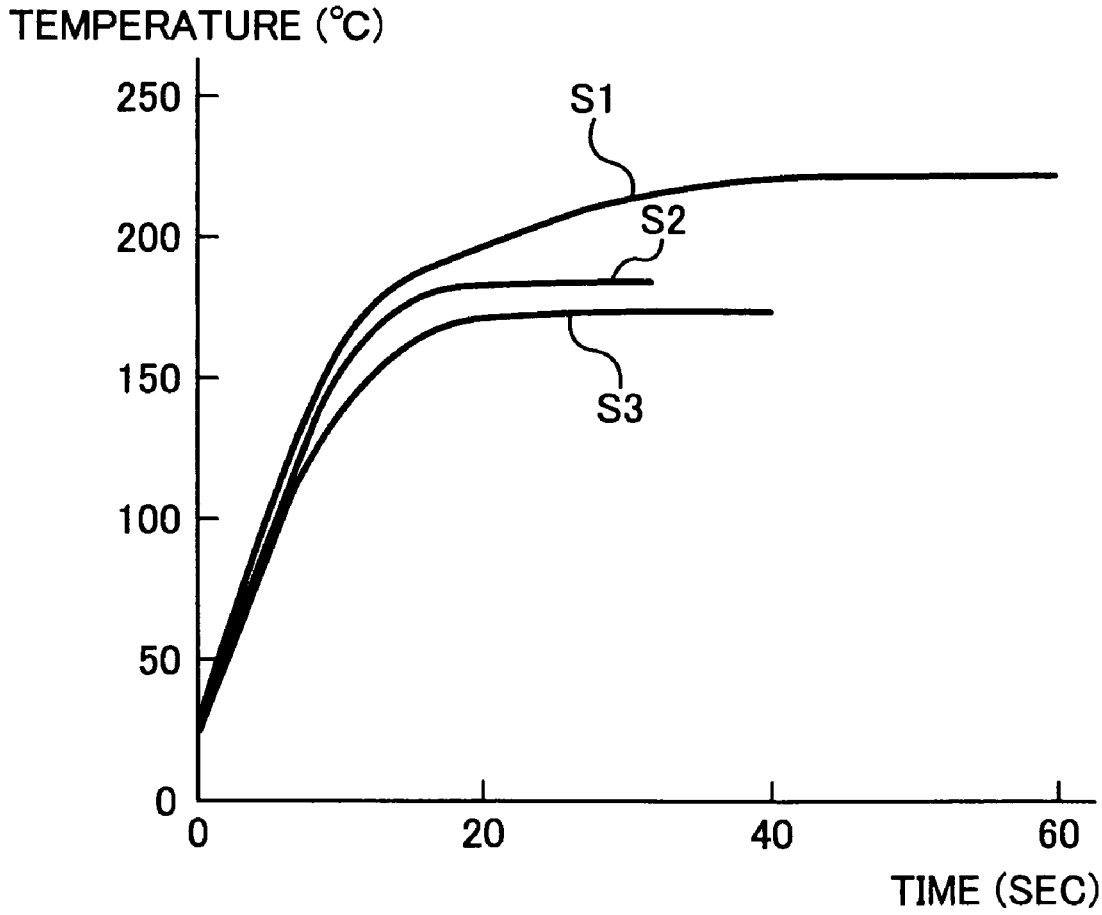
FIG. 14 is a graph representing an experimental result obtained through another experiment performed to examine the other effect of the embodiments.

With reference to FIG. 14, description will now be made of an experiment to examine the effect of changing the heating stop temperature of a heat-generating member by changing the opposed positions of an exciting member which is placed to sandwich the front surface and the rear surface of the heat-generating member without contacting the heat-generating member.

In the present experiment, an apparatus corresponding to the heating device of the first embodiment is used. In the apparatus, the coil 25 is placed to sandwich the front surface and the rear surface of a heat-generating member, which is formed solely by a conductive layer having a Curie point of approximately 190 degrees Celsius, such that the coil 25 is not in contact with the heat-generating member. The heat-generating member is a cylinder having an outer diameter of approximately 20 millimeters, a thickness of approximately 0.3 millimeters, and a width of approximately 50 millimeters. Using the thus configured apparatus, a temperature rise characteristic was examined by changing the opposing distances of the coil 25 to the heat-generating member. The frequency of the alternating current applied to the coil 25 is set to be approximately 20 kilohertz, and the electricity supplied to the coil 25 is set to be approximately 630 watts (i.e., approximately 90 volts times approximately 7 amperes). Further, the opposing distances of the coil 25 to the heat-generating member are changed such that the values M1 to M3 illustrated in FIGS. 6A to 6C fall within a range of from approximately 1 millimeters to approximately 5 millimeters.

FIG. 14 is a graph representing a result of the experiment performed by using the experimental apparatus described above. In FIG. 14, a horizontal axis indicates the time elapsed since the start of the electromagnetic induction, and a vertical axis indicates the temperature of the front surface (i.e., the primary heat-generating surface) of the heat-generating member. Further, in FIG. 14, a solid line S1 represents a temperature rise characteristic obtained when the coil 25 is located at the position illustrated in FIG. 6A, i.e., when M1 is approximately 1 millimeters. A solid line S2 represents a temperature rise characteristic obtained when the coil 25 is located at the position illustrated in FIG. 6B, i.e., when M2 is approximately 3 millimeters. Further, a solid line S3 represents a temperature rise characteristic obtained when the coil 25 is located at the position illustrated in FIG. 6C, i.e., when M3 is approximately 5 millimeters.

It is confirmed from the experimental result shown in FIG. 14 that the heating stop temperature of the heat-generating member is changed by changing the opposed positions of the coil 25 which is placed to sandwich the front surface and the rear surface of the heat-generating member without contacting the heat-generating member. Specifically, when the front-side coil portion 25*a* approaches the heat-generating member (i.e., the case represented by the solid line S1), the heating stop temperature is increased to approximately 230 degrees Celsius. Meanwhile, when the front-side coil portion 25*a* retreats from the heat-generating member (i.e., the case represented by the solid line S3), the heating stop temperature is decreased to approximately 150 degrees Celsius.

Through the use of the above-described characteristic, prompt start-up of the heat-generating member (i.e., reduction of the start-up time) and the prevention of the excessive increase in temperature by the self-temperature control of the heat-generating member can be both obtained with ease, as described in the respective embodiments.

In a case in which only the front-side coil portion 25*a* is movably configured (i.e., a configuration corresponding the configuration of the heating device of the second embodiment), too, a substantially similar experimental result to the experimental result shown in FIG. 14 was confirmed, although illustration of the experimental result is omitted.

In the embodiments described above, the present invention is applied to the fixing device of an image forming apparatus. However, the application of the present invention is not limited thereto, and thus the present invention can be applied to heating devices other than the fixing device, such as a cooking or heating device using an electromagnetic induction heating method, for example. In that case, too, similar effects as the effects of the above embodiments can be obtained. That is, in the heating devices, the prompt start-up of the heat-generating member and the prevention of the excessive increase in temperature of the fixing member by the self-temperature control of the heat-generating member can be both obtained with ease.

The above-described embodiments are illustrative and do not limit the present invention. Thus, numerous additional modifications and variations are possible in light of the above teachings. For example, elements and/or features of different illustrative and exemplary embodiments herein may be combined with each other and/or substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

The invention claimed is:

1. An image forming apparatus, comprising:

a fixing device configured to fix a toner image on a recording medium, the fixing device including a heating device, the heating device including a heat-generating member subjected to electromagnetic induction heating, an exciting member placed to sandwich a front surface and a rear surface of the heat-generating member, without contacting the heat-generating member, and means for changing an opposing distance of the exciting member to at least one of the front surface and the rear surface of the heat-generating member.

2. A fixing device for fixing a toner image on a recording medium the fixing device, comprising:

a heating device including a heat-generating member subjected to electromagnetic induction heating, an exciting member placed to sandwich a front surface and a rear surface of the heat-generating member, without contacting the heat-generating member, and means for changing an opposing distance of the exciting member to at least one of the front surface and the rear surface of the heat-generating member.

3. The fixing device as described in claim 2, further comprising:

a fixing member configured to fuse the toner image, wherein the heat-generating member includes a conductive layer having a Curie point which is equal to or higher than an approximate target controlled temperature of the fixing member and is equal to or lower than approximately 500 degrees Celsius.

4. The fixing device as described in claim 3, further comprising:

means for detecting a temperature of the fixing member, wherein the changing means includes means for changing the opposing distance of the exciting member on the basis of the temperature of the fixing member detected by the temperature detecting means.

5. The fixing device as described in claim 4, wherein the changing means includes means for moving the exciting member to reduce the opposing distance of the exciting member to the front surface of the heat-generating member, which forms a primary heat-generating surface, when the temperature of the fixing member detected by the temperature detecting means is equal to or lower than a predetermined value.

6. The fixing device as described in claim 5, wherein at a start-up of the fixing device, the changing means includes means for moving the exciting member to reduce the opposing distance of the exciting member to the front surface of the heat-generating member, which forms the primary heat-generating surface.

7. The fixing device as described in claim 6, wherein the heat-generating member is the fixing member configured to fuse the toner image.

8. The fixing device as described in claim 7, further comprising:

a pressure roller configured to apply pressure to the conveyed recording medium, wherein the fixing member is a fixing roller in contact with the pressure roller, and the exciting member is placed to face an outer circumferential surface and an inner circumferential surface of the fixing roller.

9. The fixing device as described in claim 7, wherein the fixing member is a fixing belt extended under tension in a circular shape, and the exciting member is placed to face an outer circumferential surface and an inner circumferential surface of the fixing belt.

10. The fixing device as described in claim 9, further comprising:

a support roller; and a fixing support member, wherein the fixing belt is extended under tension by the support roller and the fixing support member, and the fixing support roller is placed to contact the pressure roller via the fixing belt.

11. The fixing device as described in claim 10, wherein the exciting member is placed to face the inner circumstantial surface of the fixing belt via the support roller.

12. The fixing device as described in claim 11, wherein the heat-generating member is a heating member configured to heat the fixing member.

13. The fixing device as described in claim 12, wherein the heating member is the support roller, and the exciting member is placed to face the outer circumferential surface of the fixing belt, and to face the inner circumferential surface of the fixing belt via the support roller.

14. The fixing device as described in claim 13, further comprising:

a pressure roller configured to apply pressure to the conveyed recording medium and to contact the fixing member, wherein the exciting member is located at an upstream position of a position at which the pressure roller contacts the fixing member.

15. A heating device configured to be installed within an image forming apparatus, comprising:

a heat-generating member subjected to electromagnetic induction heating;

an exciting member placed to sandwich a front surface and a rear surface of the heat-generating member, without contacting the heat-generating member; and means for changing an opposing distance of the exciting member to at least one of the front surface and the rear surface of the heat-generating member.

16. The heating device as described in claim 15, further comprising:

means for detecting a temperature of the heat-generating member, wherein the changing means includes means for changing the opposing distance of the exciting member on the basis of the temperature of the heat-generating member detected by the temperature detecting means.

17. The heating device as described in claim 16, wherein a sum of the opposing distance of the exciting member to the front surface of the heat-generating member, which forms a primary heat-generating surface, and the opposing distance of the exciting member to the rear surface of the heat-generating member is set to be a constant value, and the changing means includes means for moving the exciting member to reduce the opposing distance of the exciting member to the front surface of the heat-generating member when the temperature of the heat-generating member is equal to or lower than a predetermined value.

18. The heating device as described in claim 16, wherein only the opposing distance of the exciting member to the front surface of the heat-generating member, which forms a primary heat-generating surface, can be changed, and the changing means includes means for moving the exciting member to reduce the opposing distance of the exciting member to the front surface of the heat-generating member when the temperature of the heat-generating member is equal to or lower than a predetermined value.

19. The heating device as described in claim 18, wherein the exciting member is a coil wound at least once to sandwich the front surface and the rear surface of the heat-generating member, the exciting member not in contact with the heat-generating member.

20. The heating device as described in claim 19, wherein the heat-generating member includes a conductive layer having a desired Curie point.

21. The heating device as described in claim 20, wherein the frequency of an alternating current applied to the exciting member for generating an alternating magnetic field falls within a range of from approximately 10 kilohertz to approximately 1 megahertz.

22. A fixing device for fixing a toner image on a recording medium, the fixing device comprising:

a heating device including a heat-generating member subjected to electromagnetic induction heating, an exciting member placed to sandwich a front surface and a rear surface of the heat-generating member, without contacting the heat-generating member, and a controllable moving mechanism configured to change an opposing distance of the exciting member to at least one of the front surface and the rear surface of the heat-generating member.

23. An image forming apparatus, comprising:

a heat-generating member subjected to electromagnetic induction heating;

an exciting member placed to sandwich a front surface and a rear surface of the heat-generating member without contacting the heat-generating member; and a controllable moving mechanism configured to change an opposing distance of the exciting member to at least one of the front surface and the rear surface of the heat-generating member.

* * * * *